US012595577B2

(12) United States Patent
De Mot et al.

(10) Patent No.: US 12,595,577 B2
(45) Date of Patent: Apr. 7, 2026

(54) SYSTEM AND METHOD FOR THE ELECTROCHEMICAL CONVERSION OF A GASEOUS COMPOUND

(71) Applicant: Universiteit Antwerpen, Antwerp (BE)

(72) Inventors: Bert De Mot, Edegem (BE); Tom Breugelmans, Nijlen (BE)

(73) Assignee: Universiteit Antwerpen, Antwerp (BE)

( * ) Notice: Subject to any disclaimer, the term of this patent is extended or adjusted under 35 U.S.C. 154(b) by 80 days.

(21) Appl. No.: 17/769,023

(22) PCT Filed: Dec. 3, 2020

(86) PCT No.: PCT/EP2020/084442
§ 371 (c)(1),
(2) Date: Apr. 14, 2022

(87) PCT Pub. No.: WO2021/110824
PCT Pub. Date: Jun. 10, 2021

(65) Prior Publication Data
US 2024/0110294 A1 Apr. 4, 2024

(30) Foreign Application Priority Data
Dec. 3, 2019 (EP) ..... 19213225

(51) Int. Cl.
*C25B 9/23* (2021.01)
*C25B 3/07* (2021.01)
(Continued)

(52) U.S. Cl.
CPC ..... *C25B 9/23* (2021.01); *C25B 3/07* (2021.01); *C25B 3/26* (2021.01); *C25B 9/05* (2021.01); *C25B 15/083* (2021.01)

(58) Field of Classification Search
None
See application file for complete search history.

(56) References Cited

U.S. PATENT DOCUMENTS

2015/0197864 A1* 7/2015 Greenbaum ..... C25B 9/00 204/266
2015/0300629 A1* 10/2015 Yu ..... B05B 5/0533 392/324

(Continued)

FOREIGN PATENT DOCUMENTS

WO 2019051609 A1 3/2019
WO WO-2019070526 A1 * 4/2019 ..... B01D 53/326

OTHER PUBLICATIONS

English translation CN 108374180 (Year: 2018).*
International Search Report and Written Opinion dated Feb. 24, 2021 from PCT International Application No. PCT/EP2020/084442.

*Primary Examiner* — Stefanie S Wittenberg
(74) *Attorney, Agent, or Firm* — Amster, Rothstein & Ebenstein LLP

(57) ABSTRACT

A system and method with improved water management for the electrochemical conversion of a gaseous compound, in particular $CO_2$, in a zero-gap electrolyzer comprises the direct injection of a liquid, such as water, in the gaseous feed comprising the gaseous compound ($CO_2$) and providing the gas/liquid mixture to the membrane electrode assembly of the zero-gap electrolyser via an interdigitated flow channel. This way, the gas and the liquid are forced through the porous electrode structures, thus ensuring that both the liquid and the gaseous compound ($CO_2$) are in close contact with the electrode, resulting in an improved hydration of the electrode and an efficient conversion of the gaseous compound ($CO_2$).

12 Claims, 9 Drawing Sheets

(51) Int. Cl.

| | |
|---|---|
| ***C25B 3/26*** | (2021.01) |
| ***C25B 9/05*** | (2021.01) |
| ***C25B 15/08*** | (2006.01) |

(56) References Cited

U.S. PATENT DOCUMENTS

| | | | | |
|---|---|---|---|---|
| 2016/0053387 | A1* | 2/2016 | Kutchcoskie | C25B 9/70<br>205/637 |
| 2019/0010620 | A1 | 1/2019 | Kaczur et al. | |
| 2019/0127865 | A1 | 5/2019 | Li et al. | |
| 2019/0233952 | A1 | 8/2019 | Sheehan | |
| 2020/0255958 | A1* | 8/2020 | Lister | C25B 3/26 |

* cited by examiner

SYSTEM AND METHOD FOR THE ELECTROCHEMICAL CONVERSION OF A GASEOUS COMPOUND

CROSS-REFERENCE TO RELATED APPLICATIONS

This application is a U.S. national stage entry under 35 U.S.C. § 371 of PCT International Patent Application No. PCT/EP2020/084442, filed Dec. 3, 2020, which claims priority to European Patent Application No. 19213225.6, filed Dec. 3, 2019, the contents of each of which are incorporated herein by reference in their entirety.

FIELD OF THE INVENTION

The present invention is generally related to the field of electrocatalysis. The present invention provides improved electrochemical systems and devices, in particular zero-gap electrolyzers, and to methods using said systems and devices for the conversion of a gaseous compound, such as $CO_2$.

BACKGROUND TO THE INVENTION

Electrochemical processes, wherein electricity is used to drive chemical reactions, have been applied in industry for a long time.

Recently, the electrochemical $CO_2$ reduction has gained a lot of interest as a potential solution for the increasing atmospheric $CO_2$ concentration, wherein, at the same time, $CO_2$ is converted into valuable carbon-based compounds. Past research has focused on a better understanding of the effect of different parameters (e.g., temperature, pressure, pH, aqueous or non-aqueous solvents, type and concentration of electrolytes, type and morphology of catalysts, impurities, type of electrodes, type of membranes, cell configuration and flow, impurities, etc.) on the $CO_2$ reduction reaction. In order to move towards an industrially mature application, the focus of the research has now shifted towards reactor design. The current state of the art reactor is a gas diffusion electrode (GDE) based zero-gap reactor where both electrodes are pressed together in a membrane electrode assembly and are separated by a polymer electrolyte membrane. In this arrangement, the redox reactions take place at the interface between the zero-gap type electrode and the membrane. In particular, the electrochemical reduction of $CO_2$ typically takes place at the interface between the cathode and the membrane. This set-up shows a high $CO_2$ mass transfer and energy efficiency.

A major problem in GDE-based $CO_2$ electrolysis is the formation of salts at the cathode, which is very detrimental to the performance of the reactor. Precipitation of (bi) carbonate is observed as a consequence of the reaction between the supplied $CO_2$ and the hydroxide ions generated at the cathode in alkaline media. In addition, solid or partially soluble products like oxalate or formate can also cause problems. Other problems related to this set-up include dehydration of the membrane electrode assembly and poor removal of products. These problems are typically related to a poor water management in the system.

In the currently known processes, $CO_2$ may be purged/bubbled through water at elevated temperatures in order to introduce water (in gaseous form) into the electrochemical cell in the form of humidified gas. For instance, WO2019051609 discloses a process and apparatus for electrocatalytically reducing carbon dioxide, wherein the carbon dioxide gas may be humidified with water vapour (i.e. in gaseous form), such as to a relative humidity of e.g. about 90%, before delivering the humidified gas to the cathode. The gas may be humidified by bubbling the carbon dioxide through water heated to a sub-boiling temperature.

However, in this process, it is very difficult to control the exact amount of water fed to the cell (e.g. due to condensation in the feed tubes) and the maximum amount of water which can be fed is determined by the saturation pressure of the water/$CO_2$ system. It is also nearly impossible to use this method outside of lab-scale set-ups. This method is thus inflexible, inaccurate and ill-suited to be implemented in an industrial scale process. There is thus a need for improved electrochemical devices and methods comprising zero-gap electrolyzers, particularly for the conversion of $CO_2$.

SUMMARY OF THE INVENTION

The present inventors have developed an electrochemical system and related method that addresses one or more of the above-mentioned problems in the art. By providing a gas/liquid mixture, particularly a gas feed comprising liquid droplets, obtained by the direct injection of a liquid (such as water) in a gas stream (such as comprising $CO_2$), to an electrochemical device, in particular a zero-gap electrolyzer, comprising a flow plate comprising an assembly of fluid distribution channels, particularly comprising one or more fluid delivery channels and one or more fluid removal channels in an interdigitated pattern, operably linked to an electrode of a membrane electrode assembly, the gas/liquid mixture, particularly both the gas and the liquid of the gas/liquid mixture, are forced through the porous electrode structures of the membrane electrode assembly, thus ensuring a good wettability of the membrane electrode assembly. In addition, the liquid will also remove and/or prevent the formation of any salts from the reaction surface. Such a flow plate, particularly a flow plate comprising interdigitated flow channels, further ensures the close contact between the gaseous compound and the electrode structures. Advantageously, the direct injection of the liquid into the gas stream allows easy and precise control of the total amount of liquid introduced into the zero-gap electrolyzer as the flowrate can be easily adjusted using a suitable pump. Furthermore, the amount of liquid provided to the zero-gap electrolyzer is not influenced by the temperature of the operation and is not limited by the liquid vapor pressure of the system. The direct liquid (water) injection also allows for easy and straightforward upscaling from lab scale set-ups to pilot plants and industrially mature processes.

Accordingly, a first aspect of the present invention provides a system for the electrochemical conversion of a gaseous compound comprising (a) a zero-gap electrolyzer comprising an energy source for applying a potential between the electrodes, a membrane electrode assembly and a flow plate comprising an assembly of fluid distribution channels operably connected to a surface of the membrane electrode assembly; wherein said membrane electrode assembly comprises a cathode catalyst layer, an anode catalyst layer and a polymer membrane interposed between the cathode catalyst layer and the anode catalyst layer; and wherein the assembly of fluid distribution channels comprises one or more fluid delivery channels and one or more fluid removal channels, separated by a permeable wall;

(b) a conduit adapted for providing a gaseous compound to the one or more fluid delivery channels; and (c) an injecting means for introducing a liquid in the conduit.

As described herein, the conduit adapted for providing a gaseous compound to the one or more fluid delivery channels can be seen as a first conduit, and the fluid which is introduced into said first conduit is provided by way of a second conduit which operably connects to said first conduit by way of the injection means. Accordingly, the system comprises (b) a first conduit (101) adapted for providing a gaseous compound to the one or more fluid delivery channels; and (c) a second conduit (102) for introducing a liquid towards said first conduit (101); and (d) an injecting means (105) configured for introducing said liquid from the second conduit (102) into the first conduit (101).

In particular embodiments, the flow plate comprising an assembly of fluid distribution channels comprises an interdigitated flow channel. In more particular embodiments, the flow plate is a cathode flow plate comprising an interdigitated flow channel, particularly when the zero-gap electrolyzer is a zero-gap $CO_2$ electrolyzer.

In particular embodiments, the injecting means is a spray nozzle, a T-piece connector or a Y-piece connector.

In particular embodiments, the system further comprises a gas/liquid separator connected to an outlet of the one or more fluid removal channels, for the separation of the reaction product, which is typically dissolved in the liquid, from the gas stream.

In particular embodiments, the zero-gap electrolyzer is a zero-gap $CO_2$ electrolyzer, wherein the membrane electrode assembly, particularly the cathode catalyst layer, is adapted for the electrolytic reduction of carbon dioxide.

In particular embodiments, the system of the present invention comprises a plurality or a stack of zero-gap electrolyzers as envisaged herein, or a plurality or a stack of individual membrane electrode assemblies and their adjacent flow plates.

A second aspect of the present invention provides for a method for the electrochemical conversion of a gaseous compound, comprising the steps of (a) introducing a liquid in a gas feed comprising the gaseous compound, particularly introducing liquid droplets in a gas feed comprising the gaseous compound, thereby generating a gas/liquid mixture;

(b) providing the gas/liquid mixture to a zero-gap electrolyzer, particularly to a surface of a membrane electrode assembly of a zero-gap electrolyzer;

(c) converting the gaseous compound into a reaction product by applying an electric potential between an anode and a cathode of the zero-gap electrolyzer.

In particular embodiments, the method for the electrochemical conversion of a gaseous compound comprises the steps of (a) introducing a liquid, particularly liquid droplets, in a gas feed comprising the gaseous compound;

(b) providing the gas/liquid mixture to an assembly of fluid distribution channels operably linked to a surface of a membrane electrode assembly of a zero-gap electrolyzer, wherein the assembly of fluid distribution channels comprises one or more fluid delivery channels and one or more fluid removal channels, separated by a permeable wall, and wherein said membrane electrode assembly comprises a cathode catalyst layer, an anode catalyst layer and a polymer membrane interposed between the cathode catalyst layer and the anode catalyst layer; and (c) converting the gaseous compound into a reaction product at an electrode catalyst layer of the membrane electrode assembly by applying an electric potential between the anode and the cathode catalyst layer of the membrane electrode assembly.

It will be understood that the introduction of a liquid, particularly liquid droplets, in a gas feed comprising the gaseous compound, results in the provision of a gas/liquid mixture.

In particular embodiments, the assembly of fluid distribution channels is in the form of an interdigitated flow channel.

In particular embodiments, the liquid is an aqueous liquid, an organic solvent or an ionic liquid. More in particular, the liquid is an aqueous liquid or an aqueous solution of organic or inorganic salts. In particular embodiments, the liquid is introduced in the gas feed with a flow between 0.05 ml/(min*A) and 1.0 ml/(min*A).

In particular embodiments, the gaseous compound is carbon dioxide or a gaseous nitrogen compound, such as ammonia. Preferably, the gaseous compound is carbon dioxide, which is reduced at the cathode catalyst layer of the membrane electrode assembly.

In particular embodiments, the gaseous compound is carbon dioxide which is reduced or converted to a reaction product, wherein said reaction product is methanol, methane, formic acid, formate, ethanol, ethylene or carbon monoxide.

In particular embodiments, the method of the present invention further comprises the step of (d) recovering the reaction product, particularly by a liquid/gas separator.

A third aspect of the present invention relates to a method for improving the water management of a zero-gap electrolyzer adapted for the conversion of a gaseous compound, comprising introducing a liquid, particularly liquid droplets, in a gas feed comprising the gaseous compound, thereby generating a gas/liquid mixture, and providing the gas/liquid mixture to a surface of a membrane electrode assembly of the zero-gap electrolyzer via an interdigitated flow channel operably linked to said surface of the membrane electrode assembly. In particular embodiments, the gas/liquid mixture is provided to a surface of a membrane electrode assembly of the zero-gap electrolyzer via an assembly of fluid distribution channels operably connected to a surface of the membrane electrode assembly; wherein the assembly of fluid distribution channels comprises one or more fluid delivery channels and one or more fluid removal channels, separated by a permeable wall, particularly via an interdigitated flow channel operably linked to said surface of the membrane electrode assembly.

FIGURE LEGENDS

FIG. 6(*b*) shows the reaction products for the different electrolyzers, with formate (striped), $H_2$ (grey) and CO (black).

FIG. 7(*b*) shows the effect of the water flow injection rate on the formate concentration in an interdigitated based zero-gap electrolyzer.

Figure 1A:
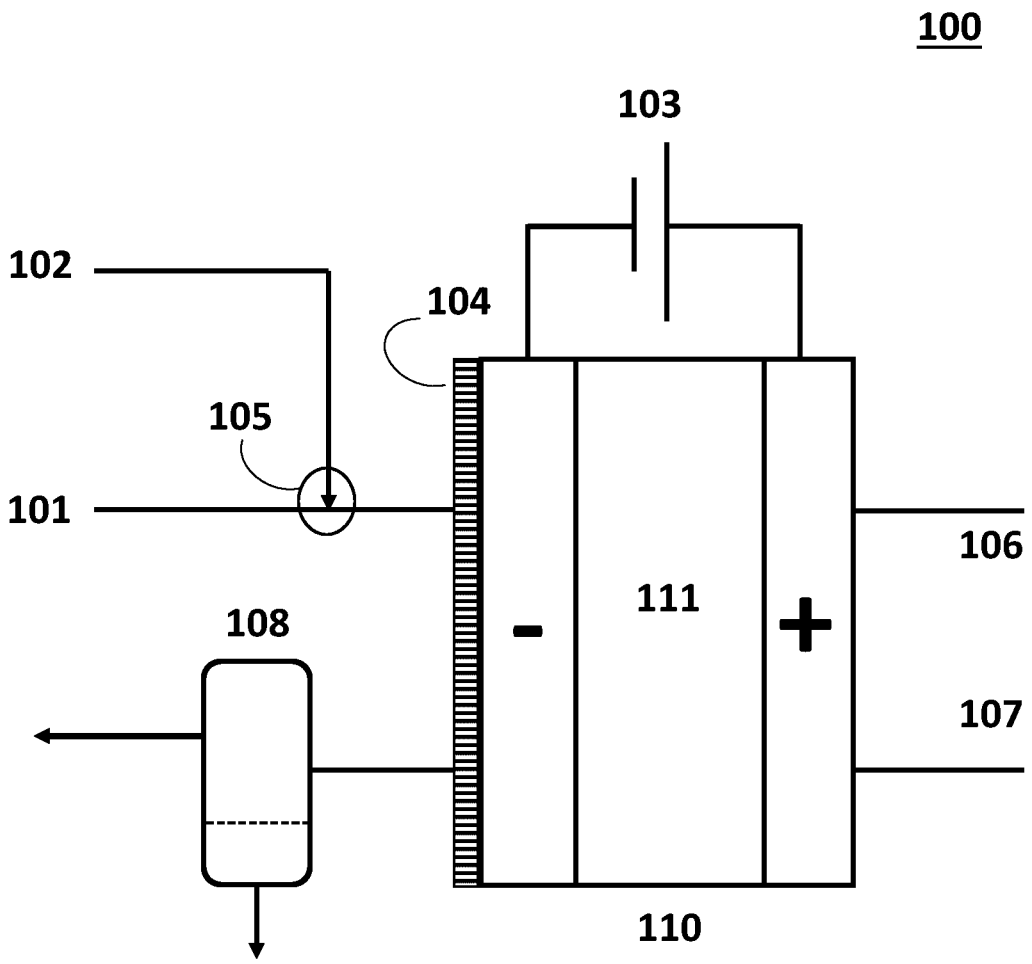
FIG. 1A shows an embodiment of a system of the present invention.

List of references: 100—system; 101—gas feed/inlet; 102—liquid feed/inlet; 103—energy source; 104—flow plate with interdigitated flow channel; 105—liquid injecting means; 106 anolyte inlet; 107—anolyte outlet; 108—gas/liquid separator; 109—back pressure regulator; 110—zero—gap electrolyzer; 111—membrane electrode assembly; 201—cover plate; 202—current collector; 203—anode flow channel; 204—sealing; 205—membrane electrode assembly; 206—cathode flow channel; 141—liquid source; 142—cathode pump; 143—source of gas feed/gaseous compound; 144—a gas flow controlling device; 145—anolyte; 146—anode pump; 147—T—mixer; 501—internal manifolding channels; 502—alignment holes; 503—inlet/outlet for the supply/removal of the gas/liquid mixture; 504—interdigitated flow channel.

DETAILED DESCRIPTION OF INVENTION

Before the present system and method of the invention are described, it is to be understood that this invention is not limited to particular systems and methods or combinations described, since such systems and methods and combinations may, of course, vary. It is also to be understood that the terminology used herein is not intended to be limiting, since the scope of the present invention will be limited only by the appended claims.

As used herein, the singular forms "a", "an", and "the" include both singular and plural referents unless the context clearly dictates otherwise.

The terms "comprising", "comprises" and "comprised of" as used herein are synonymous with "including", "includes" or "containing", "contains", and are inclusive or open-ended and do not exclude additional, non-recited members, elements or method steps. It will be appreciated that the terms "comprising", "comprises" and "comprised of" as used herein comprise the terms "consisting of", "consists" and "consists of".

The recitation of numerical ranges by endpoints includes all numbers and fractions subsumed within the respective ranges, as well as the recited endpoints.

The term "about" or "approximately" as used herein when referring to a measurable value such as a parameter, an amount, a temporal duration, and the like, is meant to encompass variations of +/−10% or less, preferably +/−5% or less, more preferably +/−1% or less, and still more preferably +/−0.1% or less of and from the specified value, insofar such variations are appropriate to perform in the disclosed invention. It is to be understood that the value to which the modifier "about" or "approximately" refers is itself also specifically, and preferably, disclosed.

Whereas the terms "one or more" or "at least one", such as one or more or at least one member(s) of a group of members, is clear per se, by means of further exemplification, the term encompasses inter alia a reference to any one of said members, or to any two or more of said members, such as, e.g., any ≥3, ≥4, ≥5, ≥6 or ≥7 etc. of said members, and up to all said members.

All references cited in the present specification are hereby incorporated by reference in their entirety. In particular, the teachings of all references herein specifically referred to are incorporated by reference.

Unless otherwise defined, all terms used in disclosing the invention, including technical and scientific terms, have the meaning as commonly understood by one of ordinary skill in the art to which this invention belongs. By means of further guidance, term definitions are included to better appreciate the teaching of the present invention.

In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to a person skilled in the art from this disclosure, in one or more embodiments. Furthermore, while some embodiments described herein include some but not other features included in other embodiments, combinations of features of different embodiments are meant to be within the scope of the invention, and form different embodiments, as would be understood by those in the art. For example, in the appended claims, any of the claimed embodiments can be used in any combination.

In the present description of the invention, reference is made to the accompanying drawings that form a part hereof, and in which are shown by way of illustration only of specific embodiments in which the invention may be practiced. Parenthesized or emboldened reference numerals affixed to respective elements merely exemplify the elements by way of example, with which it is not intended to limit the respective elements. It is to be understood that other embodiments may be utilised and structural or logical changes may be made without departing from the scope of the present invention. The following detailed description, therefore, is not to be taken in a limiting sense, and the scope of the present invention is defined by the appended claims.

The present invention is based on the surprising finding that the use of direct water injection, particularly in the form of water droplets, in a gas flow comprising a gaseous compound (e.g. $CO_2$) in combination with a flow plate comprising an assembly of fluid distribution channels, comprising one or more fluid delivery channels and one or more fluid removal channels having an interdigitated pattern, operably linked to a membrane electrode assembly result in an improved water management in zero-gap electrolyzers, such as zero-gap $CO_2$ electrolyzers, thereby preventing and addressing the problems associated with salt precipitation and poor water availability in the electrolyzer. More particularly this is ensured, while maintaining a good contact between gaseous compound and electrode, and ensuring a high conversion yield of the gaseous compound when a potential is applied over the electrolyzer.

A first aspect of the present invention provides for a system for the electrochemical conversion of a gaseous compound comprising (a) a zero-gap electrolyzer comprising an energy source, a membrane electrode assembly and a cathodic and/or anodic flow plate comprising an assembly of fluid distribution channels operably connected to a surface of the membrane electrode assembly; wherein said membrane electrode assembly comprises a cathode catalyst layer, an anode catalyst layer and a polymer membrane interposed between the cathode catalyst layer and the anode catalyst layer; and wherein the assembly of fluid distribution channels comprises one or more fluid delivery channels and one or more fluid removal channels, separated by a permeable wall or barrier;

(b) a conduit adapted for providing a gaseous compound to the one or more fluid delivery channels;

(c) an injecting means for introducing a liquid in the conduit of (b).

As described herein, the conduit adapted for providing a gaseous compound to the one or more fluid delivery channels can be seen as a first conduit, and the fluid which is introduced into said first conduit is provided by way of a second conduit which operably connects to said first conduit by way of the injection means. Accordingly, the system comprises (b) a first conduit adapted for providing a gaseous compound to the one or more fluid delivery channels; and (c) a second conduit for introducing a liquid towards said first conduit; and (d) an injecting means configured for introducing said liquid from the second conduit into the first conduit.

The injecting means is configured for introducing a liquid, particularly in the form of liquid droplets, in the first conduit via a second conduit. In particular embodiments, the second conduit and the injection means are in fluid connection with an injection pump, which drives the fluid towards in the second conduit to the injection means.

It will be understood by the skilled person, that in particular embodiments, in the assembly of fluid distribution channels, the one or more fluid delivery channels are in fluid connection with the one or more fluid removal channels via a permeable matrix, such as a porous electrode structure or a membrane of the membrane electrode assembly, or any other permeable wall or barrier, so that a fluid entering the fluid delivery channels must pass through the permeable matrix in order for the fluid to be removed by the fluid removal channels.

In particular embodiments, the present invention relates to a system for the electrochemical conversion of $CO_2$ comprising (a) a zero-gap $CO_2$ electrolyzer comprising an energy source, a membrane electrode assembly adapted for the electrochemical reduction of $CO_2$ and a cathodic flow plate comprising an interdigitated fluid distribution channel operably connected to the cathodic side of the membrane electrode assembly; (b) a conduit adapted for providing a $CO_2$ containing gaseous feed to an inlet of the interdigitated fluid distribution channel and (c) an injecting means configured for introducing an aqueous liquid, particularly in the form of droplets in the conduit. More in particular, the system comprises a second conduit leading to the injection means. In particular embodiments, the second conduit and the injection means are in fluid connection with an injection pump which drives the fluid through the second conduit towards the injection means.

In the present invention, a liquid is directly introduced or dosed into the gas feed, thereby obtaining a gas/liquid mixture, prior to the zero-gap electrolyzer. The liquid is introduced in the first conduit providing the gas feed to the zero-gap electrolyzer, via an injection means, which is particularly configured for introducing the liquid as dispersed liquid droplets in the gas feed. In particular, the injection means may be configured to provide the liquid via a second conduit to the first conduit, optionally driven by an injection pump or dosage pump linked to the second conduit. It is understood that the combined feed comprising the gaseous compound and liquid droplets dispersed or suspended therein is subsequently provided to the zero-gap electrolyzer, such as via the first conduit.

Depending on the envisaged use of the zero-gap electrolyzer, the cathodic and/or anodic flow plate comprises an assembly of fluid distribution channels comprising one or more fluid delivery channels and one or more fluid removal channels, separated by a permeable wall. Stated differently, the cathodic and/or anodic flow plate comprises an assembly of fluid distribution channels comprising one or more fluid delivery channels and one or more fluid removal channels, wherein the fluid distribution channels are in fluidic contact with the fluid removal channels via the porous electrode structure. In particular embodiments, the cathodic and/or anodic flow plate comprises an interdigitated flow channel. An interdigitated flow pattern can be compared to a maze with no end. Stated differently, it comprises an assembly of fluid distribution channels comprising one or more fluid delivery channels and one or more fluid removal channels, wherein the fluid delivery channels and fluid removal channels are connected by a permeable wall or barrier. It is understood by the skilled person that an interdigitated flow channel or fluid distribution channel as envisaged herein comprises one or more fluid delivery channels and one or more fluid removal channels. In particular embodiments, the fluid delivery channel and fluid removal channel each have a plurality of digit-shaped flow channels arranged in an interlinked comb-like pattern, wherein the one or more fluid delivery channels are in fluid connection with the one or more fluid removal channels via a permeable matrix, such as a porous electrode structure or a membrane of the membrane electrode assembly. Thus, while the inlet and the outlet of the interdigitated flow pattern are not present on the same fluid distribution channel, the fluid distribution channels or interdigitated flow channel are operably linked to the membrane assembly. Stated differently, in order to exit the flow plate and the zero-gap electrolyzer, the liquid/gas mixture is forced through a permeable wall or matrix, in particular the porous electrode structure of the membrane electrode assembly. This way, both the liquid and the gaseous compound to be converted are forced in close contact with the electrode structure. The liquid ensures that the membrane electrode assembly remains well hydrated and that detrimental salt formation is prevented. The close contact between the gaseous compound and the electrode structures promotes the efficiency of the electrochemical reduction when a potential is applied between the electrodes of the membrane electrode assembly.

Figure 1B:
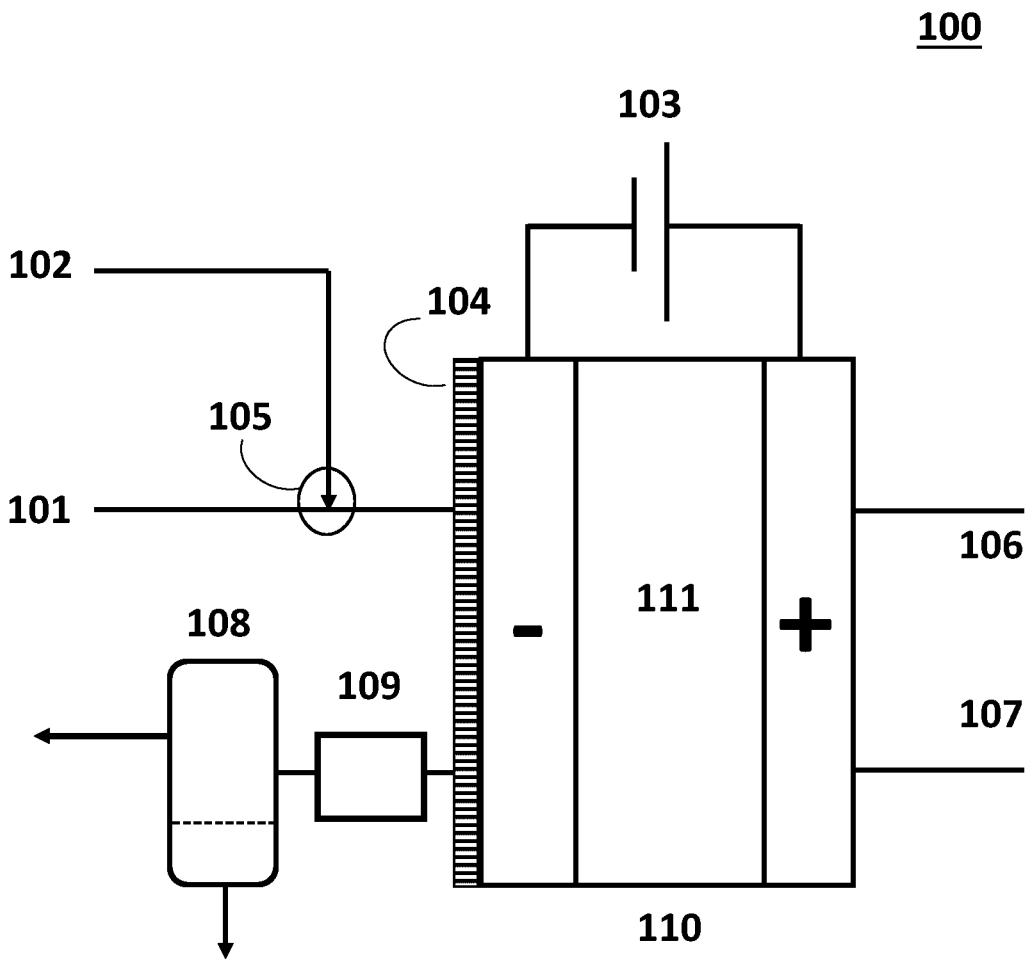
FIG. 1B shows an embodiment of a system of the present invention.

A particular embodiment of the system of the present invention is shown in FIG. 1A. This embodiment describes a system for the electrochemical conversion of a gaseous compound such as $CO_2$, whereby the electrolysis takes place at the cathode. The system (100) comprises a zero-gap electrolyzer (110), an energy source (103), a membrane electrode assembly (111) adapted for the electrochemical conversion of the gaseous compound and a flow plate comprising interdigitated flow distribution channels (104) operably connected to a surface of the membrane electrode assembly (111). The gaseous compound is provided to the electrolyzer (110) via a first conduit (101) and a liquid is provided via a second conduit (102) and an injection means (105) to the first conduit (101), thereby generating a gas/liquid mixture, particularly comprising the gaseous compound and liquid droplets dispersed or suspended therein. This gas/liquid mixture is provided via the an interdigitated flow channel (104) to the cathode of the membrane electrode assembly (111), wherein the gas/liquid mixture is forced through the porous electrode structures of the membrane electrode assembly (111). At the cathode, the gaseous compound is electrochemically converted to a reaction product by the applied potential. A gas/liquid separator (108) is provided for the recovery of the reaction product. Anolyte is provided to the anode via an anolyte inlet (106) and an anolyte outlet (107). Another embodiment of a system of the present invention is shown in FIG. 1B. In addition to the features indicated in FIG. 1A, this embodiment further comprises a back-pressure regulator (109), i.e. a device or valve adapted for maintaining a set pressure at its inlet side, allowing to perform the methods as envisaged herein at elevated pressures, such as at pressures up to 50 bar. The different elements of the system of the present invention are further discussed herein.

As envisaged herein, the reduction or conversion of the gaseous compound is performed in a zero-gap type electrochemical cell or electrolyzer. Zero-gap type electrolyzers, particularly zero-gap type $CO_2$ electrolyzers are known to the skilled person. The zero-gap electrolyzer comprises a membrane electrode assembly, having an anodic and cathodic side. An anodic flow plate, comprising an anode flow channel, is located at the anodic side of the membrane electrode assembly and is configured to allow the anolyte to contact the anode of the membrane electrode assembly. Similarly, the cathodic flow plate, comprising a cathode flow channel, is located at the cathodic side of the membrane electrode assembly. In particular embodiments of the invention at least one of the anodic and cathodic flow plates comprises an assembly of fluid distribution channels comprising one or more fluid delivery channels and one or more fluid removal channels, separated by a permeable wall. It will be understood by the skilled person, that in particular embodiments, in the assembly of fluid distribution channels, the one or more fluid delivery channels are in fluid connection with the one or more fluid removal channels via a permeable matrix, such as a porous electrode structure or a membrane of the membrane electrode assembly, or any other permeable wall or barrier. In particular embodiments, at least one of the anodic and cathodic flow plates comprises an assembly of fluid distribution channels comprising interdigitated flow channels, particularly configured to allow the anolyte and/or catholyte fluids to contact the anode or the cathode, respectively, of the membrane electrode assembly. The flow plates are made from a conductive and corrosion resistant material. They are configured to transfer charge and provide reactant to the membrane electrode assembly. The electrolyzer may further comprise current collectors, provided with suitable connectors for connecting the electrolyzer to an energy source or voltage source. Alternatively, the energy source or voltage source may be connected to the conductive flow plates. Furthermore, suitable sealings made from an electric isolating material are present to ensure gas-tight operation.

In the membrane electrode assembly, the anode and cathode are in direct contact with the membrane. More in particular, the membrane electrode assembly comprises a cathode catalyst layer, an anode catalyst layer and a polymer membrane interposed between the cathode catalyst layer and the anode catalyst layer. The electrodes in the membrane electrode assembly may be porous electrodes: a gas diffusion electrode (GDE) or gas diffusion layer (GDL) may be disposed on either side of the polymer membrane, or on both sides. Such layers promote mass transport and electron transport to the catalyst, and help prevent fouling of the membrane. When the membrane electrode assembly is in use, its anodic side will be in contact with the anolyte and its cathodic side will be in contact with the catholyte. The electrochemical reaction takes place at the interface between the electrode and the membrane. Due to the reduced distance between the electrodes in a membrane electrode assembly, voltage losses are minimized.

In particular embodiments, the zero-gap electrolyzer is a zero-gap $CO_2$ electrolyzer, comprising a membrane electrode assembly, in particular a cathode catalyst, configured to perform the electrochemical reduction of $CO_2$. When in use, the anode will be in contact with the analyte, which may be water, an alkaline or an acidic solution and the cathode will be in contact with $CO_2$, where it will be converted into economically valuable chemical compounds, such as carbon monoxide, methane, ethylene, alcohols (e.g. methanol and ethanol), and carboxylic acids (e.g. formic acid, acetic acid, glycolic acid, glyoxylic acid, and oxalic acid).

The polymer membrane present in the membrane electrode assembly may be any polymer membrane known in the art for use in conducting ionic species, such as protons. In some embodiments, the polymer membrane may be a cationic ion-exchange membrane, e.g. a perfluorosulfonic acid membrane, such as Nafion®; or a perfluorocarboxylic acid membrane, such as Flemion®. In some embodiments, the polymer membrane is an anionic ion-exchange membrane. In some embodiments the polymer membrane is a bipolar membrane comprised of a combination of an anion and a cation exchange membrane.

A catalyst is disposed on the sides of the polymer membrane, with an anode catalyst or catalyst layer disposed on the anodic side, and a cathode catalyst or catalyst layer, particularly adapted for the electrochemical reduction of carbon dioxide on the cathodic side of the membrane.

Many catalysts suitable for the electrochemical reduction of a gaseous compound, particularly $CO_2$, are known in the art. Suitable catalysts may comprise (but are not limited to materials comprising) tin (Sn), tin oxide ($SnO_2$), lead (Pb), silver (Ar), gold (Au), nitrogen doped carbon, copper (Cu), bismuth (Bi) and zinc (Zn). The selection of an appropriate (cathode) catalyst determines the selectivity for a particular reaction product, and reduced production of byproducts. Advantageously, a metal oxide catalyst, such as $SnO_2$ allows to obtain a certain current density at lower cell voltage, thus lowering operation costs.

In a zero-gap $CO_2$ electrolyzer according to the invention, the cathode flow plate comprises an assembly of fluid distribution channels comprising one or more fluid delivery channels and one or more fluid removal channels, separated by a permeable wall, such as an interdigitated flow channel.

It will be understood by the skilled person, that in particular embodiments, in the assembly of fluid distribution channels, such as in the interdigitated flow channels, the one or more fluid delivery channels are in fluid connection with the one or more fluid removal channels via a permeable matrix, such as a porous electrode structure or a membrane of the membrane electrode assembly.

The anode catalyst or catalyst layer may be adapted for the production of oxygen, according to the reaction: $2H_2O \rightarrow 4e^- + 4H^+ + O_2$. This reaction may occur in an acidic or alkaline environment or solution. In an acidic environment, the anode catalyst or catalyst layer may comprise iridium. In an alkaline environment, the anode catalyst or catalyst layer may comprise platinum or nickel.

Figure 2:
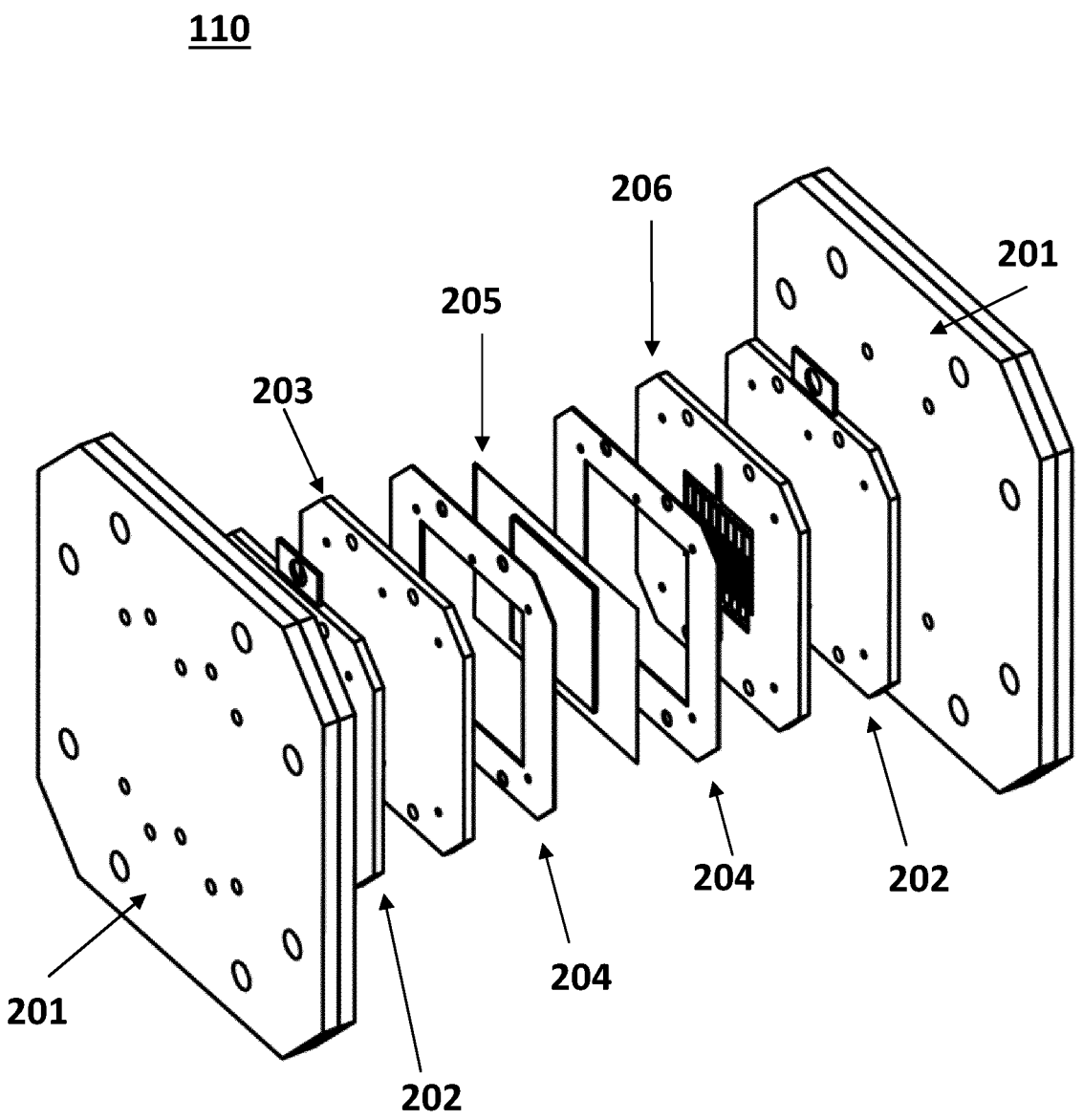
FIG. 2 shows an expanded view of the components making up a zero-gap electrolyzer according to an embodiment of the present invention.
Figure 3:
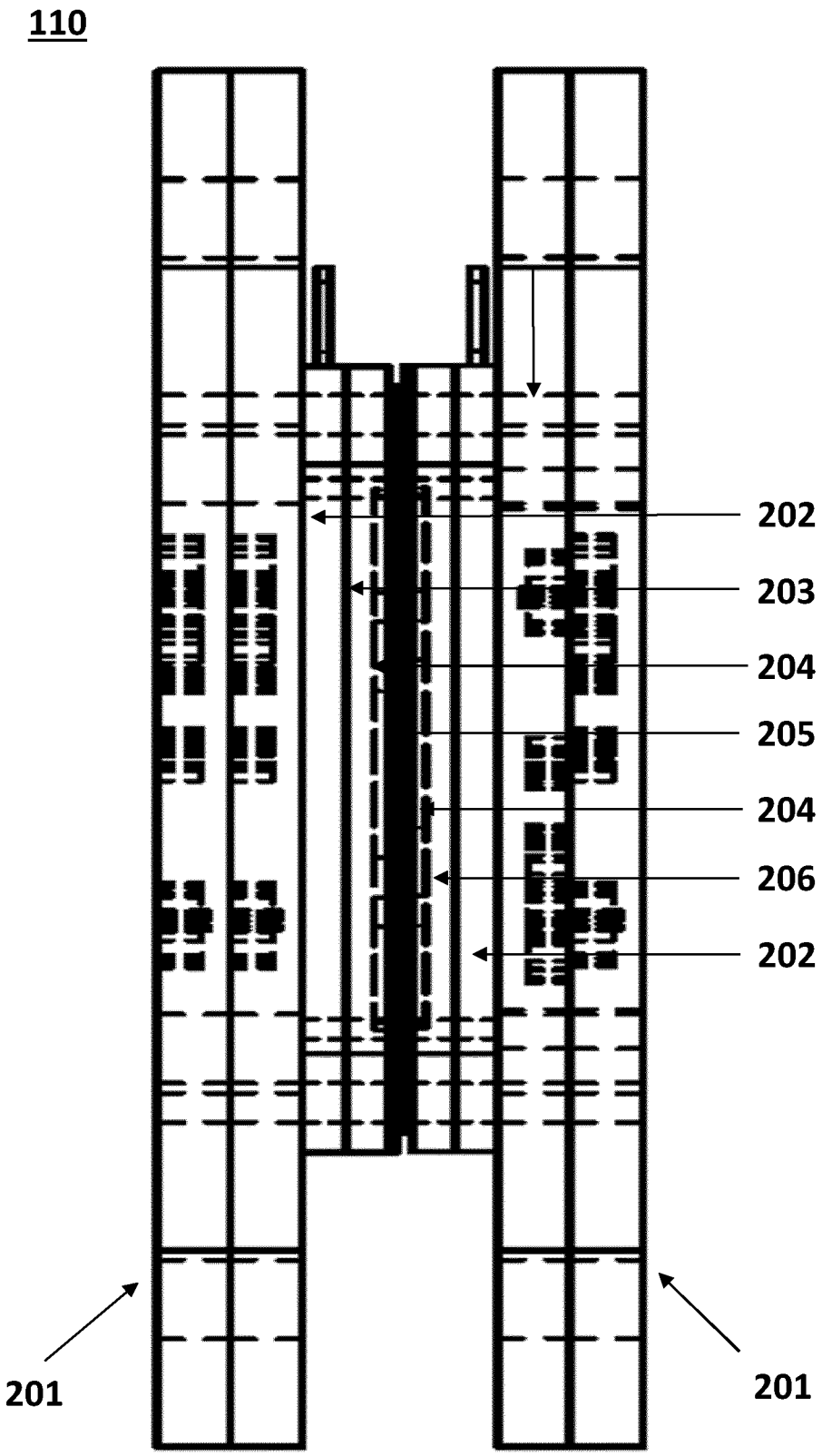
FIG. 3 shows the side view of a zero-gap electrolyzer according to an embodiment of the present invention.

FIG. 2 and FIG. 3 show the different components of a zero-gap electrolyzer (110), particularly a zero-gap $CO_2$ electrolyzer, according to a particular embodiment of the present invention. The electrolyzer is closed by two cover plates (201). Current collectors (202) are provided with connectors for connecting the electrolyzer (110) to an energy source. An anode flow channel (203) allows the anolyte to contact the anode of the membrane electrode assembly (205). A cathode flow channel (206) comprising an interdigitated flow channel allow the distribution of the gas/liquid mixture to the cathode of the membrane electrode assembly (205). The electrolyzer further comprises sealings (204), particularly situated between the flow channels (203, 206) and the membrane electrode assembly (205).

The present system further comprises an injection means for introducing a liquid in the first conduit adapted for providing a gaseous compound to the electrolyze. In particular embodiments, the liquid is introduced via a second conduit to the injection means. Suitable injection means for introducing a liquid product, particularly in the form of a spray of dispersed liquid droplets, are known in the art and include a spray nozzle, such as an atomizer nozzle, a T-piece connector or a Y-piece connector. Particularly preferred are spray nozzles, such as atomizer nozzles, which allow to introduce the liquid in the first conduit in the form of an aerosol. The flow rate of the liquid and the gaseous feed are controlled by suitable pumps or flow controllers. Depending on the use of the electrolyzer, the injection means for introducing a liquid in the first conduit adapted for providing a gaseous compound to the electrolyzer is positioned to ensure direct contact with the cathode or the anode flow channel. In particular embodiments, where the electrolyzer is a zero-gap $CO_2$ electrolyzer, the injection means is used for introducing a liquid into a gaseous feed comprising $CO_2$ and the injection means is positioned so as to introduce the liquid into the cathode flow plate comprises an assembly of fluid distribution channels comprising one or more fluid delivery channels and one or more fluid removal channels, separated by a permeable wall, such as an interdigitated flow channel. It will be understood by the skilled person, that in particular embodiments, in the assembly of fluid distribution channels, such as in the interdigitated flow channels, the one or more fluid delivery channels are in fluid connection with the one or more fluid removal channels via a permeable matrix, such as a porous electrode structure or a membrane of the membrane electrode assembly.

In particular embodiments, the system further comprises a gas/liquid separator connected to an outlet of the electrolyzer, particular to an outlet of the one or more fluid removal channels of the (cathodic) flow plate. Suitable gas/liquid separators are known in the art.

In a particular embodiment, the system further comprises a back-pressure regulator, which may be provided at the cathode outlet, at the anode outlet or at both the cathode outlet and the anode outlet of the electrolyzer. The back-pressure regulator allows to operate the system as envisaged herein in a high-pressure set-up, in particular at a pressure up to 50 bar, such as between 1 and 50 bar, preferably between 2 and 20 bar. Advantageously, since in the present system a gaseous compound, in particular carbon dioxide, is provided to the electrolyzer, increasing the pressure, in particular while maintaining a constant temperature, will increase the carbon dioxide concentration provided to the electrolyzer, according to the principles of the ideal gas law. This allows higher partial current densities for the carbon dioxide electroreduction as envisaged herein at lower cell voltages. Advantageously, by providing a back-pressure regulator at both the cathode and the anode outlet, high pressure differences between the anode and cathode side of the electrolyzer as envisaged herein can be prevented, reducing the risk of membrane failure.

Advantageously, the system of the present invention is easily scalable by connecting multiple electrolyzers. Accordingly, in particular embodiments, the system comprises a plurality of electrolyzers, preferably a stack of electrolyzers, or a plurality or stack of membrane electrode assemblies and the associated flow plates.

A second aspect of the present invention provides a method for the electrochemical conversion of a gaseous compound, comprising the steps of introducing a liquid, particularly liquid droplets, in a gas feed comprising the gaseous compound, thereby generating a gas/liquid mixture;

(b) providing the gas/liquid mixture to a zero-gap electrolyzer, particularly to a surface of a membrane electrode assembly of a zero-gap electrolyzer;

(c) converting the gaseous compound into a reaction product by applying an electric potential between an anode and a cathode of the zero-gap electrolyzer.

More in particular, the method for the electrochemical conversion of a gaseous compound comprises the steps of (a) introducing a liquid in a gas feed comprising the gaseous compound, particularly introducing and dispersing liquid droplets in a gas feed comprising the gaseous compound, such as via a second conduit, thereby generating a gas/liquid mixture;

(b) providing the gas/liquid mixture to an assembly of fluid distribution channels operably connected to a surface of a membrane electrode assembly of a zero-gap electrolyzer, wherein the assembly of fluid distribution channels comprises one or more fluid delivery channels and one or more fluid removal channels, separated by a permeable wall or barrier, and wherein said membrane electrode assembly comprises a cathode catalyst layer, an anode catalyst layer and a polymer membrane interposed between the cathode catalyst layer and the anode catalyst layer. Preferably, the assembly of fluid distribution channels is in the form of an interdigitated flow channel. This way, an electrode catalyst layer is contacted with both the gaseous compound and the liquid;

(c) converting the gaseous compound into a reaction product at an electrode catalyst layer of the membrane electrode assembly by applying an electric potential between the anode and the cathode catalyst layer of the membrane electrode assembly.

It will be understood by the skilled person, that in particular embodiments, in the assembly of fluid distribution channels, the one or more fluid delivery channels are in fluid connection with the one or more fluid removal channels via a permeable matrix, such as a porous electrode structure or a membrane of the membrane electrode assembly.

In particular embodiments, a method for the electrochemical reduction of $CO_2$ is provided, comprising the steps of (a) introducing a liquid, particularly aqueous liquid droplets, in a $CO_2$-containing gas stream, such as via a second conduit, thereby generating a gas/liquid mixture;

(b) providing the gas/liquid mixture to a flow plate comprising an assembly of fluid distribution channels comprises one or more fluid delivery channels and one or more fluid removal channels, separated by a permeable wall or barrier such as an interdigitated flow channel operably connected to the cathodic surface of a membrane electrode assembly of a zero-gap $CO_2$ electrolyzer, thereby contacting the cathode catalyst layer with the $CO_2$-containing gas and the liquid;

(c) converting the $CO_2$ into a reaction product at the cathode catalyst layer of the membrane electrode assembly by applying an electric potential between the anode and the cathode catalyst layer of the membrane electrode assembly.

It will be understood by the skilled person, that in particular embodiments, in the assembly of fluid distribution channels, such as in the interdigitated flow channels, the one or more fluid delivery channels are in fluid connection with the one or more fluid removal channels via a permeable matrix, such as a porous electrode structure or a membrane of the membrane electrode assembly.

Typically, in the electrochemical reduction of $CO_2$, the reaction is performed using electricity as the energy source, coupled with an anodic half-reaction (e.g. water oxidation) that provides electrons and protons required to reduce $CO_2$.

In particular embodiments, the gaseous compound is carbon dioxide or a gaseous nitrogen compound, such as ammonia or nitrogen oxides. More in particular, the gaseous compound is carbon dioxide, which is reduced at the cathode catalyst layer of the membrane electrode assembly, wherein the cathode catalyst layer is adapted to convert or reduce $CO_2$ in a reaction product. Suitable membrane electrode assemblies and catalyst layers are described above. Particular $CO_2$ reaction products include carbon monoxide, methane, ethylene, alcohols (e.g. methanol and ethanol), and carboxylic acids (e.g. formic acid, acetic acid, glycolic acid, glyoxylic acid, and oxalic acid).

In particular embodiments, a $CO_2$-containing gas stream may be obtained from a pre-combustion process, a combustion exhaust gas or flue gas of a combustion process (e.g. from blast furnaces or power plants), from a natural gas stream, from synthesis gas, from a carbon dioxide exhaust, and/or any other carbon dioxide-containing source. The $CO_2$-containing gas stream may comprise between 0.4% (v/v) and 100% (v/v) of $CO_2$, such as between 1 and 99% (v/v), between 3 and 95% (v/v) or between 5% (v/v) and 90% (v/v). The $CO_2$-containing gas stream may be treated to remove contaminants or impurities that would negatively affect the chemical conversion.

In particular embodiments, the method as envisaged herein, particularly steps (a), (b) and step (c) of the method as envisaged herein, more particularly steps (b) and (c) of the method as envisaged herein, is performed at a pressure of up to 50 bar, such as ranging between 1 and 50 bar, particularly ranging between 2 and 20 bar. The pressure can be maintained and set by providing a back-pressure regulator at the cathode outlet of the electrolyzer.

In particular embodiments, the liquid is an aqueous liquid, an organic solvent or an ionic liquid. Preferably, the liquid is water or an aqueous solution, such as a water/alcohol mixture, or an aqueous solution of organic or inorganic salts. In particular embodiments, the liquid is introduced into the gaseous feed at a rate between 0.5 and 1 ml/(min*A), preferably between 0.0625 ml/(min*A) and 0.625 ml/(min*A). Lower liquid flow rates may not provide sufficient liquid to the membrane electrode assembly to prevent salt precipitation, which may be detrimental to the electrolyzer performance. With a higher flow rate, the reaction products are typically obtained in a more diluted form, and thus require more effort to be recovered.

Furthermore, the minimum liquid flow rate of the liquid may be estimated or calculated from the following equation:

$$F_{winj}=S-F_{w,co2in}+F_{w,co2out}-F_{wdrag}+F_{wdiff}+rW$$

where $F_{w\ inj}$ is the amount of liquid, such as water, that was injected, S is the minimum amount of liquid (water) required for solubilizing the salts, $F_{wdrag}$ the amount of liquid (water) dragged through the membrane to the cathode due to electro-osmosis, $F_{wdiff}$ the amount of liquid (water) transported from the cathode due to back-diffusion, rW the amount of liquid (water) consumed in the reactions, $F_{w,co2in}$ and $F_{w,co2uit}$ are the amounts of liquid (water) in gaseous form present in the $CO_2$ stream entering and leaving the cell. It is understood that, in certain embodiments, the amount of liquid (water) transported due to back-diffusion and the saturated $CO_2$ streams can be neglected.

The liquid may be introduced in the gaseous feed by any injecting means known in the art, particularly any injection means known and configured for introducing and dispersing liquid droplets in a gaseous flow, including but not limited to a spray or atomizing nozzle; T-piece connection; or y-piece connection.

In the methods of the present invention, a sufficient electrical potential between the anode and the cathode in the electrolyzer is applied for the cathode to reduce the gaseous compound, into the reduced reaction product. In particular embodiments, where the gaseous compound is $CO_2$, the electrical potential between the anode and cathode may be 10 V or less. An electrical potential between 0.1-5 V per cell is more preferred, and 0.1-3 V per cell is most preferred. Higher electric potentials result in higher energy consumption and potentially in degradation of reactor components, such as electrodes. The current density provided in the electrolyzer is between 50 mA/cm$^2$ and 1 000 mA/cm$^2$, such as between 75 and 750 mA/cm$^2$. Higher current densities improve the reaction rate.

In particular embodiments, the method further comprises the step of (d) recovering the reaction product, particularly by a liquid/gas separator.

Preferably, the method of the invention is performed in a continuous manner, which may be more efficient, as products may be obtained in significantly larger amounts and require lower operating costs.

The present invention further provides a method for improving the water management of a zero-gap electrolyzer, comprising introducing a liquid in a gas feed comprising a gaseous compound, thereby generating a gas/liquid mixture, and providing the gas/liquid mixture to a surface of a membrane electrode assembly of the zero-gap electrolyzer via an assembly of fluid distribution channels comprises one or more fluid delivery channels and one or more fluid removal channels, separated by a permeable wall or barrier, such as an interdigitated flow channel operably linked to said surface of the membrane electrode assembly. It will be understood by the skilled person, that in particular embodiments, in the assembly of fluid distribution channels, such as in the interdigitated flow channels, the one or more fluid delivery channels are in fluid connection with the one or more fluid removal channels via a permeable matrix, such as a porous electrode structure or a membrane of the membrane electrode assembly.

EXAMPLES

Figure 4:
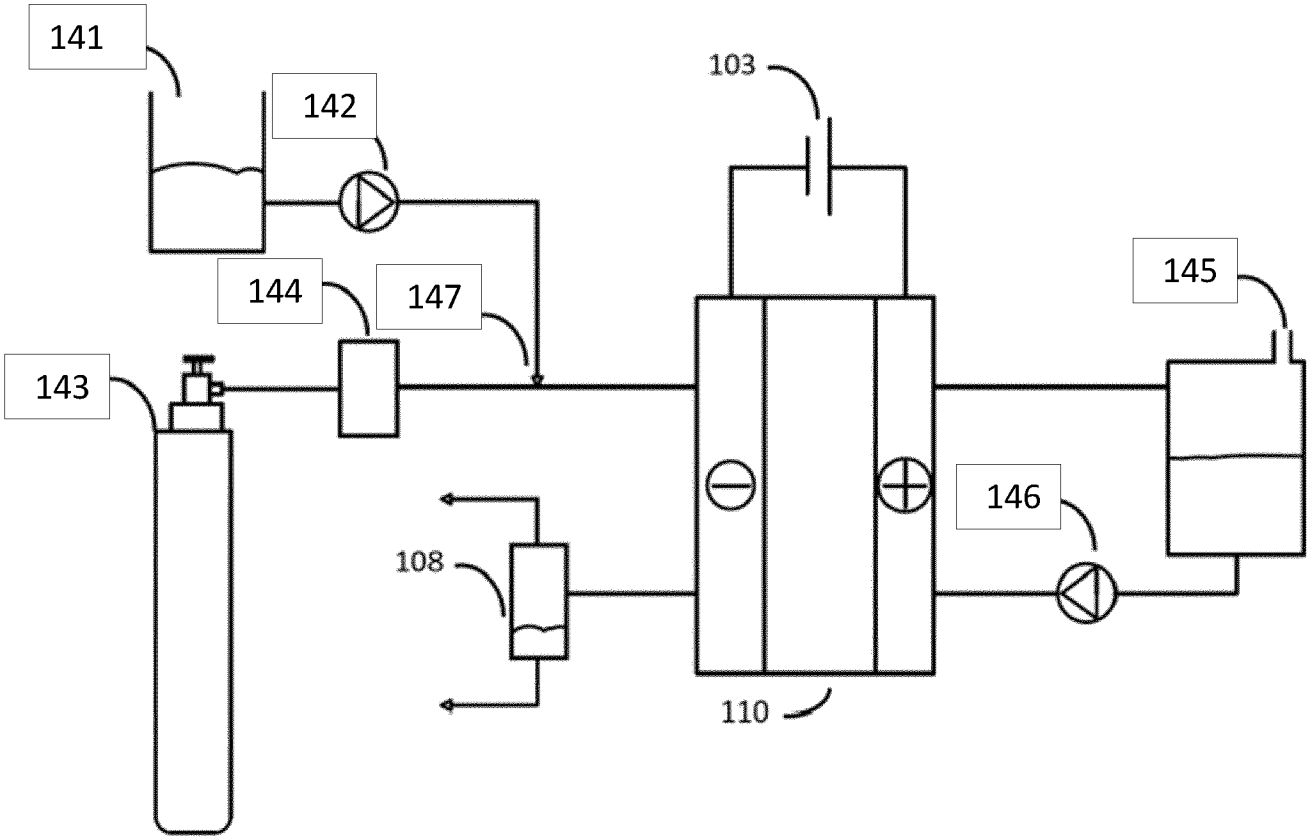
FIG. 4 shows an embodiment of the system of the present invention, used in the experimental setup.

Example 1—Experimental Setup of the Electrochemical System with Direct Water Injection The experimental setup comprising a custom made zero-gap $CO_2$ electrolyzer is schematically represented in FIG. 4. A gas flow controlling device (144) is used to control the flow of $CO_2$ (143) to the zero-gap electrolyzer (110), comprising a Ni-Foam/Nafion117/Sn-GDE membrane electrode assembly. A cathode pump (142), i.e. a precision HPLC pump, regulates the flow of the water (141). The water is directly injected in the $CO_2$ flow by a T-mixer (147) and results in the creation of a gas/liquid mixture, which is led to the electrolyzer via an interdigitated flow channel (504), represented in FIG. 5. In the flow plate, inlets and outlets (503) are made for the supply and removal of the gas/water mixture. At the sides, internal manifolding channels (501) allow for the transport of other products, such as cooling liquid or anolyte through the zero-gap electrolyzer (110). Alignment holes (502) were drilled in the material to allow proper alignment of all the different components of the zero-gap electrolyzer.

An energy source (103) powers the zero-gap $CO_2$ electrolyzer (110). The humidified $CO_2$ reacted towards formate at the catalyst surface of the Sn-GDE. The reaction products obtained by the electrochemical conversion of $CO_2$ are separated in a gas/liquid separator (108). The anode pump (109) controls the flow of the anolyte (106).

The minimum amount of water injection that is required to prevent salt precipitation in the cathode compartment was estimated from the water balance, according to the following formula:

$$F_{winj}=S-F_{w,co2in}+F_{w,co2out}-F_{wdrag}+F_{wdiff}+rW$$

where $F_{w\ inj}$ is the amount of water that was injected, S is the minimum amount of water required for solubilizing the salts, $F_{wdrag}$ the amount of water dragged through the membrane to the cathode due to electro-osmosis, $F_{wdiff}$ the amount of water transported from the cathode due to back-diffusion, rW the amount of water consumed in the reactions, $F_{w,co2in}$ and $F_{w,co2uit}$ are the amounts of gaseous water present in the $CO_2$ stream entering and leaving the cell. The amount of water transported due to back-diffusion and the saturated $CO_2$ streams can be neglected.

The required amount of water injection thus depends mainly on the solubility of the salts, the electro-osmotic drag coefficient, and the consumption/production of water due to reactions. At the cathode, potassium formate and potassium bicarbonate are formed, thus the amount of water in the cathode compartment should exceed the combined solubility limit of both salts to avoid crystallization. It was calculated that a minimum water flow (=S) of 0.3 ml/min is necessary to remove all the salts formed at 100 mA/cm$^2$.

The amount of water consumed can be derived from the following reactions

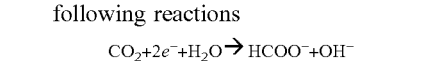

$$CO_2+2e^-+H_2O \rightarrow HCOO^-+OH^-$$

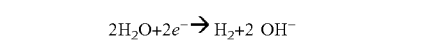

$$2H_2O+2e^- \rightarrow H_2+2\ OH^-$$

If a 80% Faraday Efficiency (FE) towards formate is assumed at 100 mA/cm$^2$, using Faraday's law, this results in a combined water consumption (=rW) of 0.011 ml/min. The amount of water transported due to electro-osmotic drag can be estimated from the formula $F_{wdrag}=A.i.n_d/F$ (wherein A is the area of the membrane, i the current density, $n_d$ the electro-osmotic drag coefficient (as reported for Nafion 117), and F the Faraday's constant). An $F_{wdrag}$ of 0.089 ml/min was calculated for a constant current of 100 mA/cm$^2$ and a $n_d$ of 5. Based on these values, the total amount of additional water that has to be injected to prevent crystallization (=$F_{winj}$) was calculated to be 0.22 ml/min.

Example 2—Zero-Gap Electrolyzer Performance

The performance of the zero gap electrolyzer according to the setup presented in example 1 was compared in a similar setup wherein the zero-gap electrolyzer was replaced by a catholyte flow-by type reactor. The major difference between these two reactor lay-outs is the absence of a catholyte flow channel in the zero-gap electrolyzer.

Figure 5:
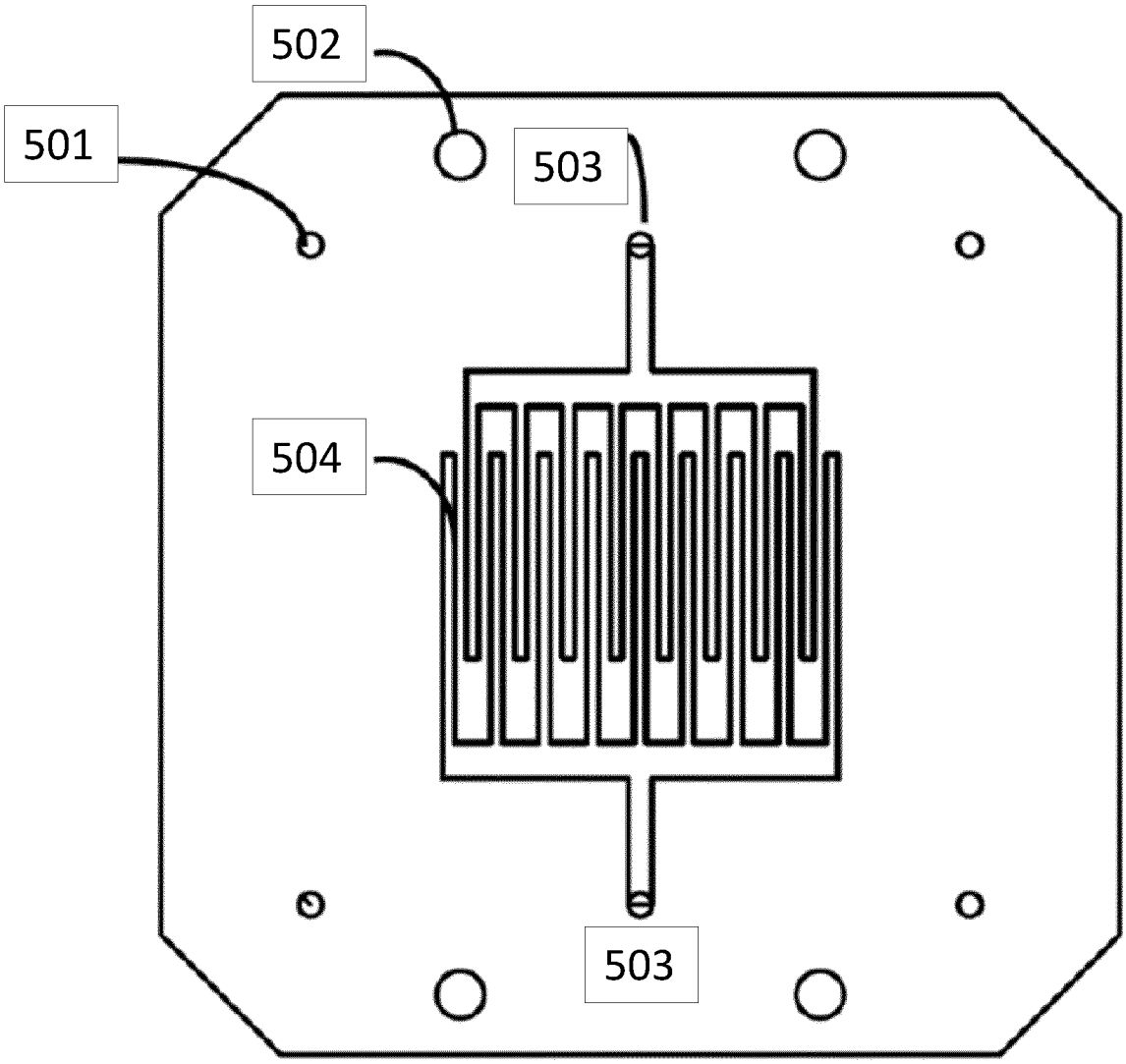
FIG. 5 shows a detail of an interdigitated flow channel, as used in the zero-gap $CO_2$ electrolyzer in the experimental setup.

For the zero-gap reactor two types of gas flow patterns were tested: (a) a parallel pattern, in which the mass transfer to the gas diffusion electrode occurs only by diffusion and (b) an interdigitated pattern (as shown in FIG. 5), which can be described as a "maze without exit", in which the mass transfers occurs both by diffusion and convection. The experiments were executed for 3600 s at 100 mA/cm$^2$, the $CO_2$ flowrate was 200 ml/min and 0.3 ml/min water was injected in the gas stream for humification of the process.

Figure 6A:
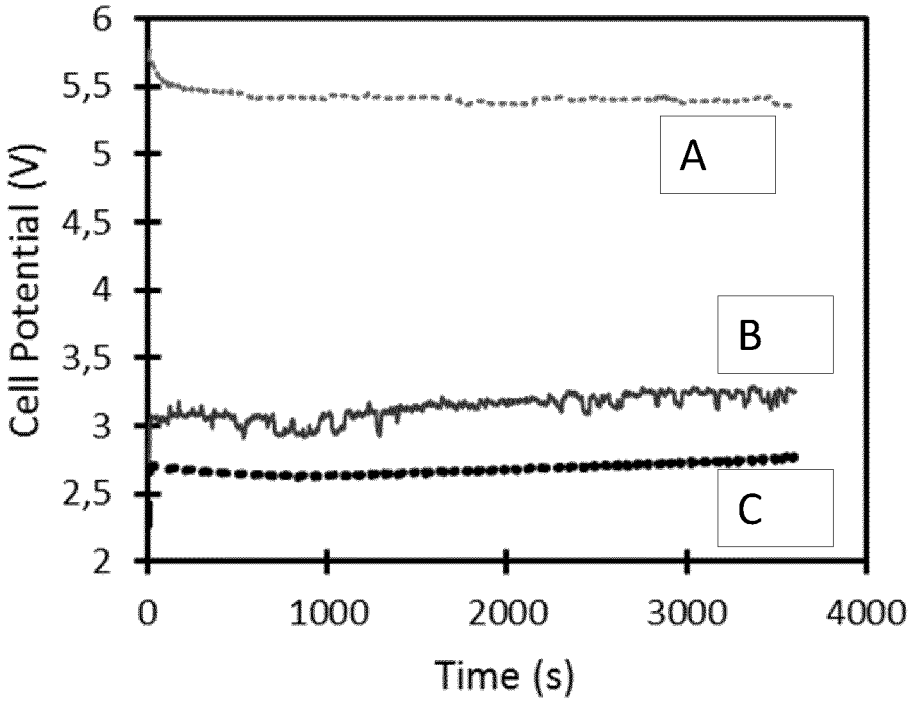
FIG. 6(*a*) shows the cell potential in function of time for a catholyte based, non-zero-gap, electrolyzer (A), a zero-gap electrolyzer with a parallel flow pattern (B) and a zero-gap electrolyzer with an interdigitated flow channel (C).
Figure 6B:
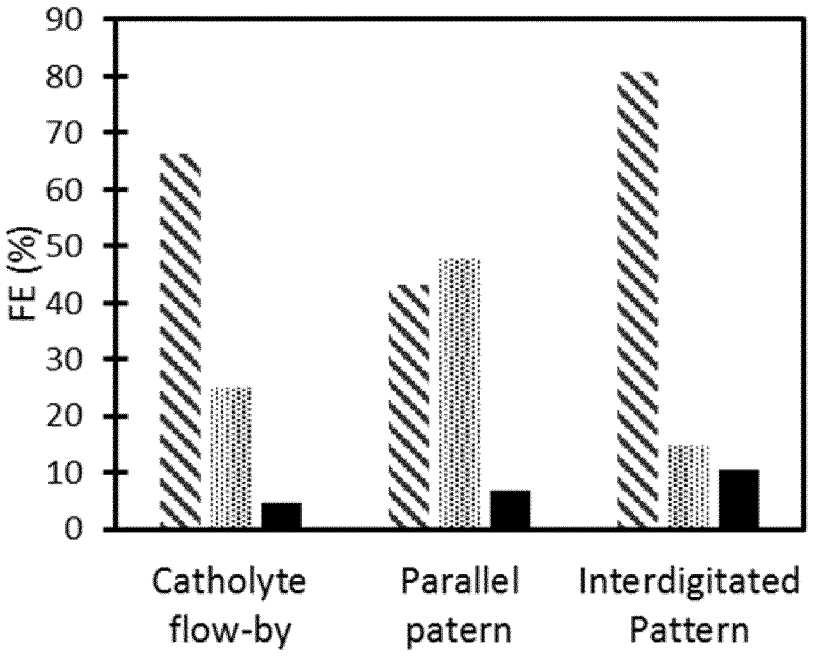

It can be seen from FIG. 6(*a*) that the removal of the catholyte flow channel has a positive effect on the performance of the cell.

In the setup comprising the catholyte flow-by electrolyzer (as a comparative example), the cell potential was 5.5 V for 100 mA/cm$^2$, while the zero-gap electrolyzer had a cell potential of only 3.2 V and 2.7 V for the parallel and interdigitated flow pattern respectively. In addition, a large difference between the two flow patterns of the zero-gap electrolyzer was noted: the interdigitated pattern had a 0.5 V lower cell potential and was significantly more stable than the parallel flow channel, in which the cell response had potential spikes up to several 100 millivolts. In the parallel flow pattern, mass transfer occurred exclusively through diffusion. In view of the hydrophobicity of the gas diffusion electrode, it is hypothesized that most of the water injected in the cell did not reach the catalyst surface, resulting in a poor humidification of the membrane electrode assembly. This in its turn increased the cell resistance, and led to poor product removal. Due to the accumulation of products at the catalyst surface the voltage spiked.

On the other hand, when the interdigitated flow channel was used, $CO_2$ was forced into the gas diffusion electrode and the mass transfer toward the gas diffusion electrode was thus a combination of both diffusion and convection. Moreover, water was also pushed into the gas diffusion electrode, resulting in a more effective humidification of the membrane electrode assembly. Due to the optimized water transport, the accumulation of reaction products was prevented and no voltage spikes were observed.

Similar observations could be made on the product yield or FE (Faraday Efficiency) of the different electrolyzers. The results of the product analysis are visualized on FIG. 6(*b*).

With the catholyte flow-by electrolyzer an average FE towards formate of around 67% was obtained. The side products were mainly $H_2$ (25%) and to lesser extend CO (5%). The cumulative FE was 97%, proving the analysis methods were sufficiently accurate.

For the zero-gap electrolyzer, a big difference was observed between the interdigitated flow pattern, showing an 81% FE towards formate, and the parallel flow pattern, which showed a 43% FE towards formate. Without wishing to be bound by theory, this may be ascribed to the increased mass transfer and humidification performance of the interdigitated channel resulting in a better $CO_2$ transport and wettability of the catalyst surface.

In conclusion, the zero-gap reactor outperformed the catholyte flow-by channel both on FE towards formate as on the cell voltage, overall resulting in a more energy efficient system. Furthermore, the type of flow pattern used in the zero-gap electrolyzer had an immense impact on the performance. An interdigitated flow pattern outperformed the parallel flow pattern due to improved mass transfers of both $CO_2$ and water.

Example 3—Effect of Water Injection Flow Rate on Reactor Performance

The influence of the water injection flow rate on the performance of a zero gap electrolyzer equipped with an interdigitated flow channel was examined by varying the water injection flow rate between 0.1 ml/min and 1 ml/min. Experiments of 1 h duration were carried out at 100 mA/cm$^2$ with a $CO_2$ flowrate of 200 ml/min. The results are shown in FIG. 7(*a*).

In example 1, a minimum water injection of 0.22 ml/min was calculated in order to prevent salt crystallization. Running the experiment at 0.1 ml/min initially gave good performance with an average FE towards formate of 87% and a cell potential of 2.77 V. However, after 50 minutes the pressure in the gas channel rose rapidly, causing the experiment to be stopped. After dissembling the cell big clusters of crystalized salts were identified in the gas channel, completely blocking the passage of $CO_2$. When the water injection flow rate was increased to 0.2 ml/min, the 1 h experiment could be finished without any visual salt deposits after disassembling of the cell, validating the theoretical value calculated in example 1. A further increase of the water flow rate did not had a substantial impact on both the FE towards formate and the cell potential, as all values were situated around 80% and 2.7 V, respectively.

Figure 7A:
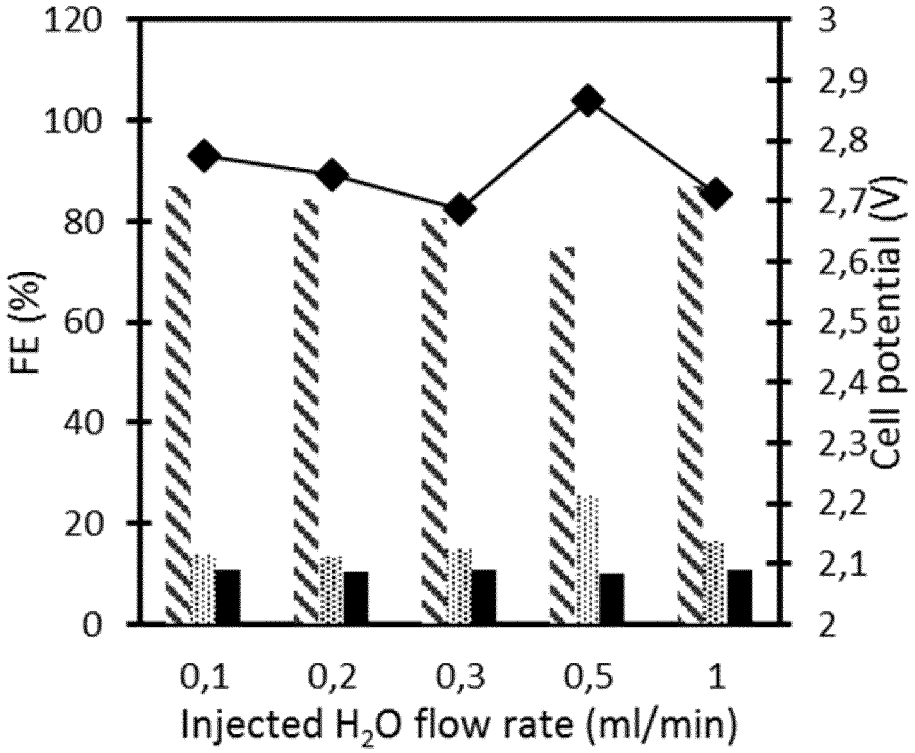
FIG. 7(*a*) shows the effect of the water injection flow rate on the reaction products [formate (striped), $H_2$ (grey) and CO (black)] and the cell potential.
Figure 7B:
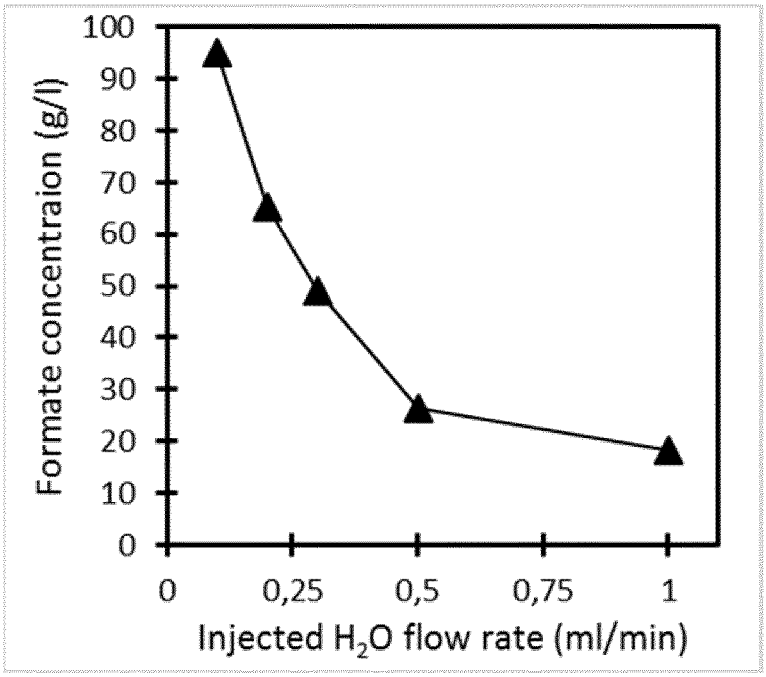

The concentration of the final product was heavily influenced by the flow rate, as shown in FIG. 7(*b*). At the lowest flowrate, a formate concentration of 95 g/I was achieved, but as indicated above, this result was only stable for 50 minutes due to salt precipitation. At 0.2 ml/min, a constant formate concentration of 65 g/I was reached over the course of 60 minutes. Upon further increasing the water flow rate, the formate concentration decreased, as the same amount of product was dissolved in higher volumes of water. To the best of the inventors' knowledge, these are some of the highest formate concentrations in a single pass at 100 mA/cm$^2$ reported.

Example 4—Different Catalysators

The performance of a zero gap electrolyzer according to the setup presented in example 1 comprising a Ni-Foam/Nafion117/Sn-GDE membrane electrode assembly, i.e. with Sn as catalyst, was compared to the performance of a zero gap electrolyzer according to the setup presented in example 1 comprising a Ni-Foam/Nafion117/$SnO_2$-GDE membrane electrode assembly, i.e. with $SnO_2$ as catalyst.

Figure 8:
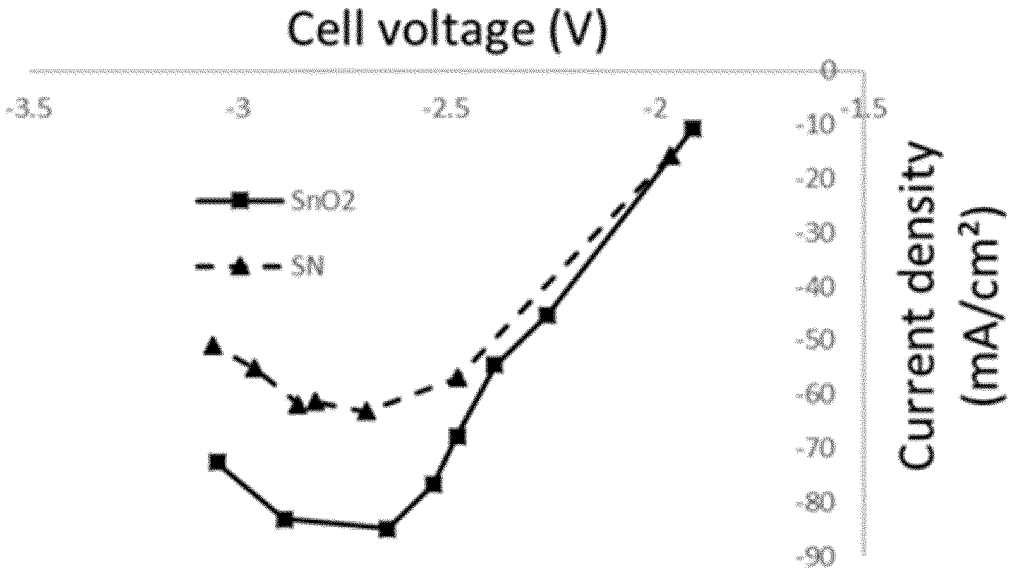
FIG. 8 shows the current density in function of cell voltage for a zero-gap electrolyzer according to an embodiment of the present invention, comprising Sn or $SnO_2$ as catalyst.

Both the zero-gap electrolyzer with Sn as catalyst and the zero-gap electrolyzer with $SnO_2$ as catalyst resulted in high formate yield. As illustrated in FIG. 8, $SnO_2$ seems a better catalyst than Sn, as a higher current density can be obtained with $SnO_2$ as catalyst. Stated differently, a lower cell voltage can be used with the $SnO_2$ catalyst to reach a certain current density, thereby lowering operations costs.

The invention claimed is:

1. A system (100) for the electrochemical conversion of a gaseous compound comprising (a) a zero-gap electrolyzer (110) comprising an energy source (103), a membrane electrode assembly (111) and a flow plate comprising an assembly of fluid distribution channels (104) operably connected to a surface of the membrane electrode assembly (111); wherein said membrane electrode assembly (111) comprises a cathode catalyst layer, an anode catalyst layer and a polymer membrane interposed between the cathode catalyst layer and the anode catalyst layer; and wherein the assembly of fluid distribution channels comprises one or more fluid delivery channels in fluid connection with one or more fluid removal channels via a permeable matrix;

(b) a first conduit (101) adapted for providing a gaseous compound to the one or more fluid delivery channels; and (c) a second conduit (102) for introducing a liquid towards said first conduit (101); and (d) an injecting means (105) configured for introducing said liquid from the second conduit (102) into the first conduit (101) thereby generating a gas/liquid mixture in the first conduit, which gas/liquid mixture is provided through the one or more fluid delivery channels to the surface of the membrane electrode assembly (111) and which gas/liquid mixture is subsequently forced through the permeable matrix of the membrane electrode assembly, thereby hydrating the membrane electrode assembly and removing and/or preventing the formation of any salts from the surface.

2. The system (100) according to claim 1, wherein the flow plate comprising the assembly of fluid distribution channels (104) comprises an interdigitated flow channel (504).

3. The system (100) according to claim 1, wherein the injecting means (105) is a spray nozzle, a T-piece connector or a Y-piece connector.

4. The system (100) according to claim 1, further comprising a gas/liquid separator (108) connected to an outlet of the one or more fluid removal channels.

5. The system (100) according to claim 1, wherein the membrane electrode assembly (111), is adapted for the electrolytic reduction of carbon dioxide.

6. The system (100) according to claim 1, further comprising a back-pressure regulator (109) at the cathode outlet, at the anode outlet or at the cathode outlet and the anode outlet.

7. The system (100) according to claim 1, comprising a plurality of electrolyzers or membrane electrode assemblies and associated flow plates.

8. The system (100) according to claim 1, wherein the cathode catalyst layer of the membrane electrode assembly (111) is adapted for the electrolytic reduction of carbon dioxide.

9. The system (100) according to claim 1, wherein the permeable matrix is as a porous electrode structure or a membrane of the membrane electrode assembly.

10. The system (100) according to claim 1; wherein the flow plate comprising the assembly of fluid distribution channels (104) is a cathode flow plate comprising an interdigitated flow channel (504).

11. The system (100) according to claim 1, comprising a stack of electrolyzers or a stack of membrane electrode assemblies and associated flow plates.

12. The system (100) according to claim 1, wherein the injection means is driven by an injection pump linked to the second conduit, and wherein the injection pump controls a minimum liquid flow rate according to the equation $$F_{winj}=S-F_{w,co2in}+F_{w,co2out}-F_{wdrag}+F_{wdiff}+rW,$$

with $F_{winj}$ is the amount of liquid that is injected;

S is the minimum amount of liquid required for solubilizing salts;

$F_{wdrag}$ is the amount of liquid dragged through the membrane to the cathode due to electro-osmosis;

$F_{wdiff}$ is the amount of liquid transported from the cathode due to back-diffusion;

rW is the amount of liquid consumed in the electrochemical reactions;

$F_{w,co2in}$ and $F_{w,co2uit}$ are the amounts of liquid in gaseous form present in the gas entering and leaving the cell, respectively.

* * * * *